US006969077B2

(12) United States Patent
Liu

(10) Patent No.: US 6,969,077 B2
(45) Date of Patent: Nov. 29, 2005

(54) TWO-WAY CASTER BENCH

(75) Inventor: Guang-Bin Liu, Tai-Shan (TW)

(73) Assignee: Shinn Fu Corporation, Tao Yuan (TW)

( * ) Notice: Subject to any disclaimer, the term of this patent is extended or adjusted under 35 U.S.C. 154(b) by 92 days.

(21) Appl. No.: 10/628,510

(22) Filed: Jul. 29, 2003

(65) Prior Publication Data

US 2005/0023780 A1 Feb. 3, 2005

(51) Int. Cl.[7] ..... B25H 5/00
(52) U.S. Cl. ..... 280/30; 280/32.6
(58) Field of Search ..... 280/30, 32.5, 32.6, 280/638, 639, 640, 651, 657, 79.11, 79.2, 280/79.3; 297/129, 311, 283.1, 283.2; 403/53, 403/98

(56) References Cited

U.S. PATENT DOCUMENTS 456,044 A * 7/1891 Mabye ..... 403/98
2,571,443 A * 10/1951 Hair ..... 248/397
4,505,495 A * 3/1985 Foss et al. ..... 280/651
4,640,301 A * 2/1987 Battiston et al. ..... 135/67
5,451,068 A * 9/1995 Shockley ..... 280/32.6
5,738,365 A * 4/1998 McCarthy ..... 280/651
6,095,532 A * 8/2000 Martin ..... 280/32.6
6,105,719 A * 8/2000 Lensing ..... 182/116
6,199,877 B1 * 3/2001 Shockley ..... 280/32.6
6,398,234 B1 * 6/2002 Brown ..... 280/32.6
6,425,590 B1 * 7/2002 Whiteside et al. ..... 280/32.6

FOREIGN PATENT DOCUMENTS

WO 88/09709 * 12/1988 ..... 280/32.6

* cited by examiner

*Primary Examiner*—Frank Vanaman
(74) *Attorney, Agent, or Firm*—Bacon & Thomas PLLC

(57) ABSTRACT

A two-way caster bench comprises a front chair frame, a middle chair frame and a rear chair frame. The front chair frame is a U-shaped frame having a predetermined number of casters installed underneath, whose free ends are pivotally connected with the middle chair frame. The middle chair frame is composed of two U-shaped frames connected by a pair of connecting bars, with the free ends facing outwardly. One U-shaped frame is for a pivotal connection to the front chair frame, and another is for a pivotal connection to the rear chair frame. The rear chair frame is also a U-shaped frame having a predetermined number of casters installed underneath, the bottom of which is provided with a transverse bar for supporting the middle chair frame as it is folded toward the rear chair frame. Each of the chair frames is provided with a cushion.

7 Claims, 8 Drawing Sheets

TWO-WAY CASTER BENCH

BACKGROUND OF THE INVENTION (a) Field of the Invention

The present invention relates to two-way caster benches, and more particularly to a two-way caster bench that is easily convertible between a folded configuration for sitting and a flat configuration for lying and is freely movable on the ground.

(b) Description of the Prior Art

Work-related chairs of the prior art are for facilitating working under unusual situations, such as maintenance work under vehicles or machines. To fit into these situations, they are designed to be a flat bench. There is however another type of work-related chairs for people to step on. In this case, the chairs are designed to be of an upright configuration. Since the conventional work-related chairs are either a lying bench or a stepping chair, a work place sometimes has to be provided with these two types of chairs, which waste available workspace and increase production cost.

SUMMARY OF THE INVENTION

Accordingly, the primary objective of the present invention is to provide a two-way caster bench that is convertible between a sitting configuration and a lying configuration. It is composed of a front chair frame, a middle chair frame and a rear chair frame. The front chair frame is a U-shaped frame having a predetermined number of casters installed underneath. The free ends of the U-shaped frame are pivotally connected with the middle chair frame. The middle chair frame is composed of two U-shaped frames connected by a pair of connecting bars, with the free ends of the frames facing outwardly. One U-shaped frame is for pivotal connection to the front chair frame. Another U-shaped frame is for pivotal connection to the rear chair frame. The rear chair frame is also a U-shaped frame having a predetermined number of casters installed underneath. The bottom of the rear U-shaped frame, close to the free ends thereof, is provided with a transverse bar for supporting the middle chair frame after the middle chair frame is folded toward the rear chair frame. Each of the chair frames is provided with a cushion.

The secondary objective of the present invention is to provide a two-way caster bench, wherein a stopper is installed at each of the pivoting points between the front chair frame and the middle chair frame to control the folding angle between the front chair frame and the middle chair frame.

It is a further objective of the present invention to provide a locating device mounted on one of the pivoting points between the rear chair frame and the middle chair frame for locking the middle chair frame in its folded configuration, the device being defined by the middle chair frame being supported by the supporting bar of the rear chair frame. The locating device assures the safety of the two-way caster bench.

DETAILED DESCRIPTION OF THE PREFERRED EMBODIMENTS

Figure 1:
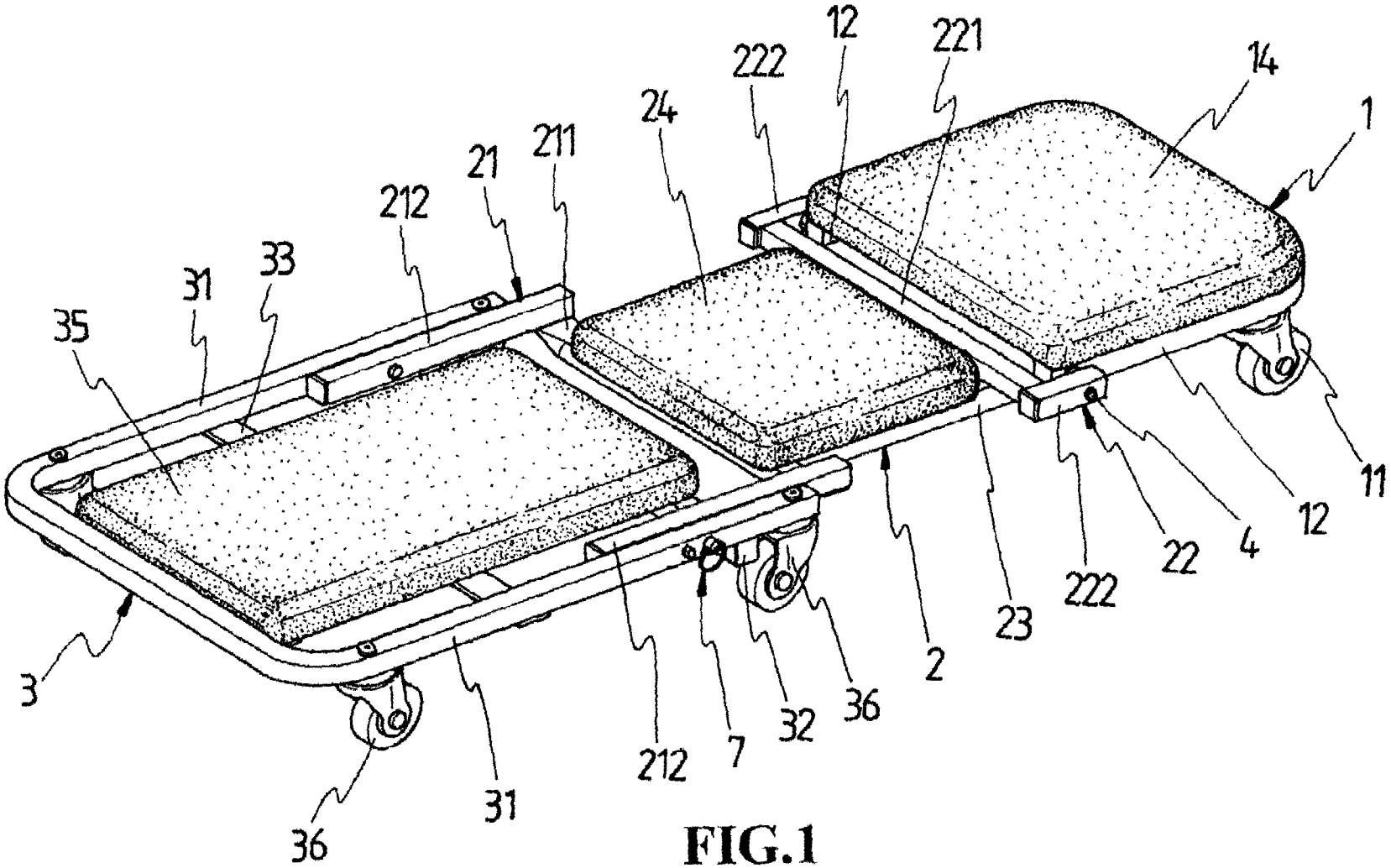
FIG. 1 is a perspective view of the present invention.
Figure 2:
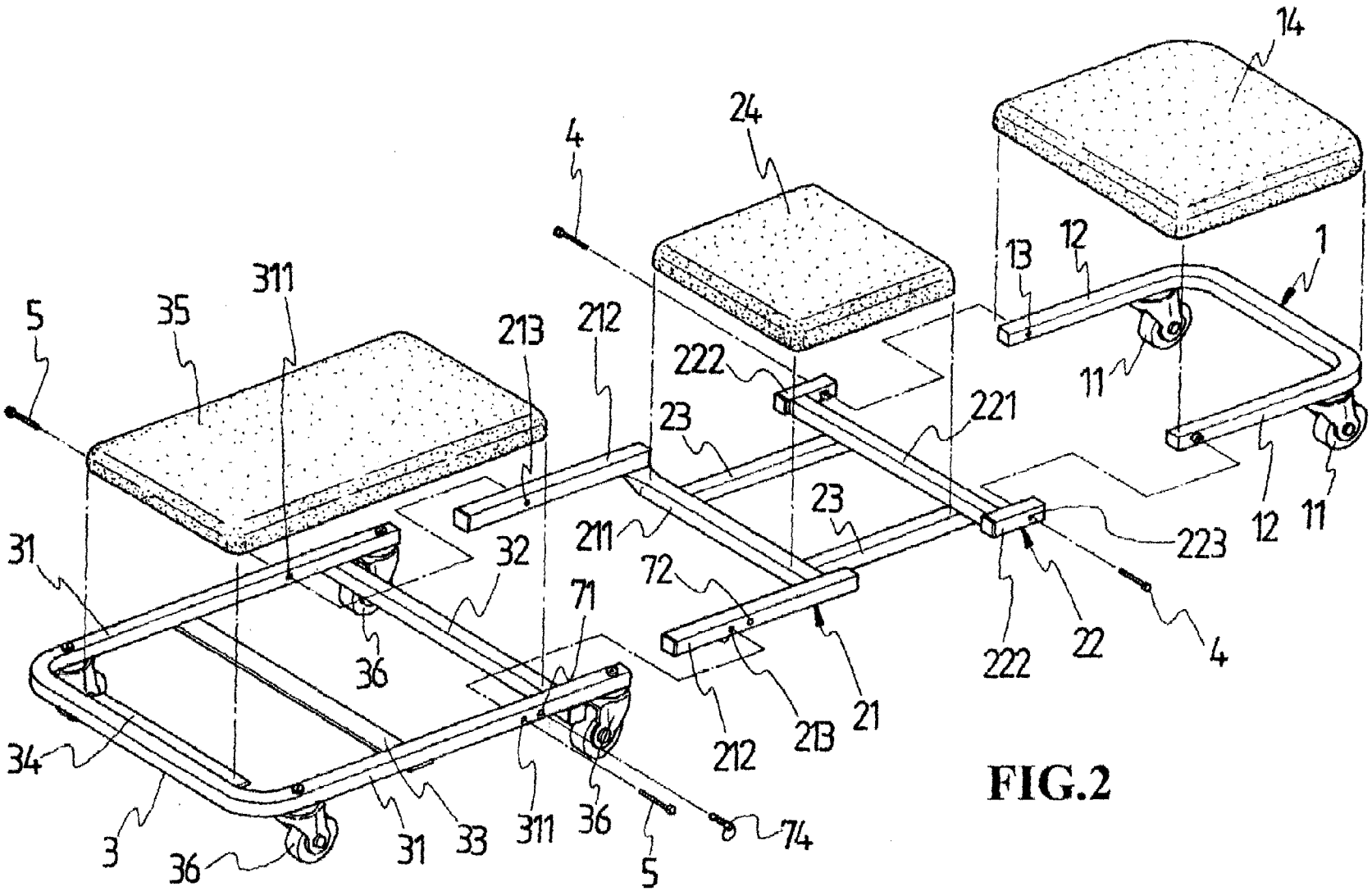
FIG. 2 is an exploded perspective view of the present invention.

Referring to FIG. 1 and FIG. 2, the present invention is a two-way caster bench which mainly includes a front chair frame 1, a middle chair frame 2 and a rear chair frame 3.

Referring to FIG. 2, the front chair frame 1 is a U-shaped frame made by folding a single bar or welding a number of bars together, in which two casters 11 are installed at two pre-selected locations in the front lateral portion thereof. Each of the free ends of lateral bars 12 of the U-shaped frame is provided with a pivot hole 13 which goes through the lateral bars in a direction parallel to the central transverse bar of the U-shaped frame. A cushion 14 is mounted on the upper side of the front chair frame 1.

Referring to FIG. 2, the middle chair frame 2 mainly includes a long U-shaped frame 21 and a short U-shaped frame 22, each made by folding a single bar or welding a number of bars together. The long and short U-shaped frames, placed back to back with the free ends of their longer and shorter lateral bars facing outwardly, are connected by a pair of connecting bars 23 whose two ends are respectively welded onto the central transverse bars 211 and 221. Each of the lateral bars 212 of the short U-shaped frame 21 is provided with a pivot hole 213 on the lateral side thereof. Each of the lateral bars 222 of the long U-shaped frame 22 is provided with a pivot hole 223. A cushion 24 is mounted on the upper side of the pair of connecting bars 23.

Referring to FIG. 2, the rear chair frame 3 is a U-shaped frame made by folding a single bar or welding a number of bars together, the lateral side of each of two lateral bars 31, is each provided with a pivot hole 311 going through the bar. A supporting bar 32 is transversely mounted in the front portion of the U-shaped frame, underneath the lateral bars 31 thereof. At least one supporting plate 33 is mounted in the middle portion of the U-shaped frame underneath the lateral bars 31. A supporting plate 34 is further mounted underneath the rear end of the U-shaped frame. A cushion 35 is mounted on the upper sides of the supporting bar 32, the supporting plates 33 and the supporting plate 34. Each of the front and rear ends of the lateral bars 31 is provided with a caster 36 at a pre-selected location. The rear chair frame 3 thus has a total of four casters 36, which facilitate free movement of the rear chair frame 3 on the ground.

Figure 3:
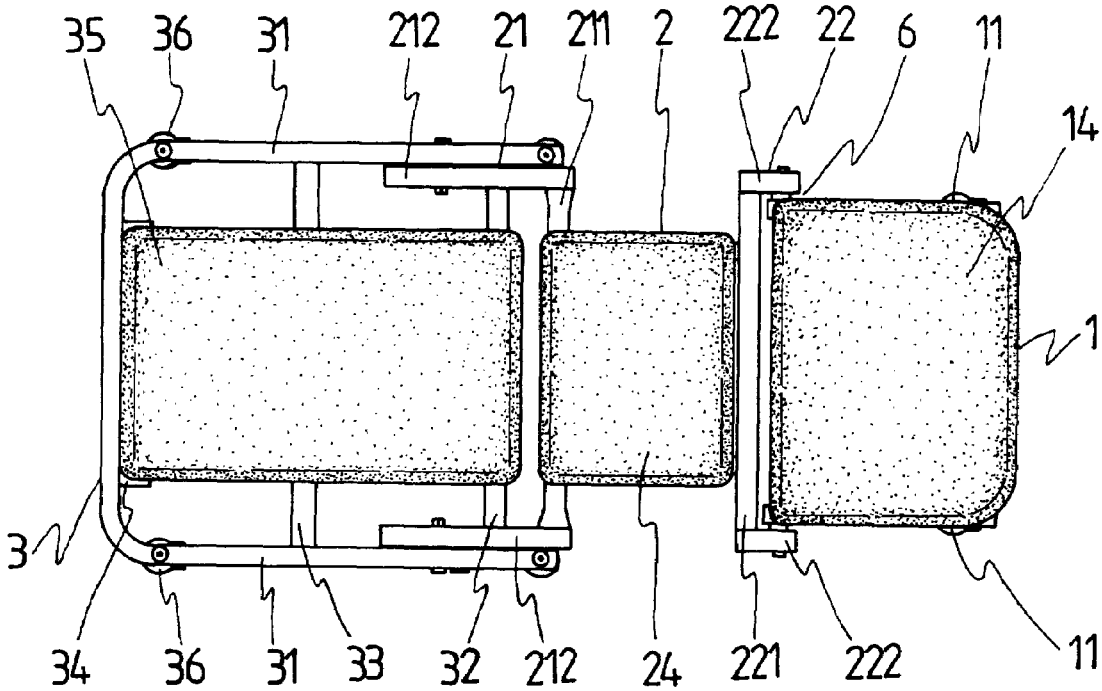
FIG. 3 is a top view of the present invention.
Figure 4:
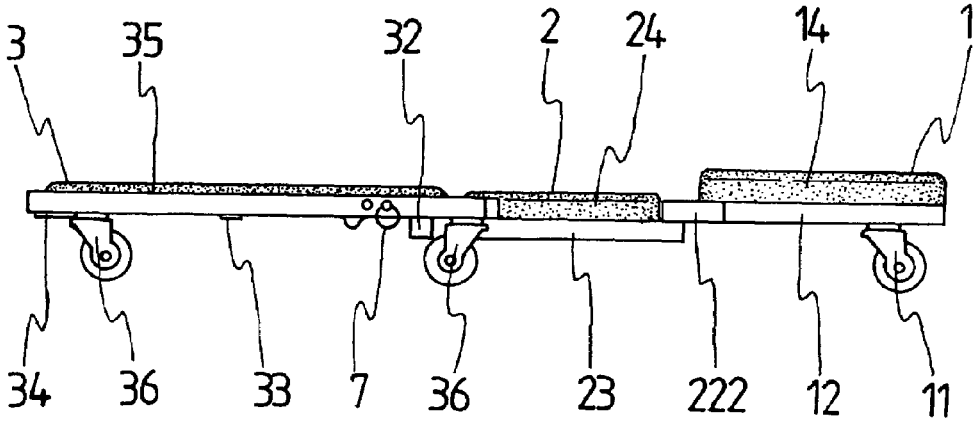
FIG. 4 is a left side elevational view of the present invention.
Figure 5:
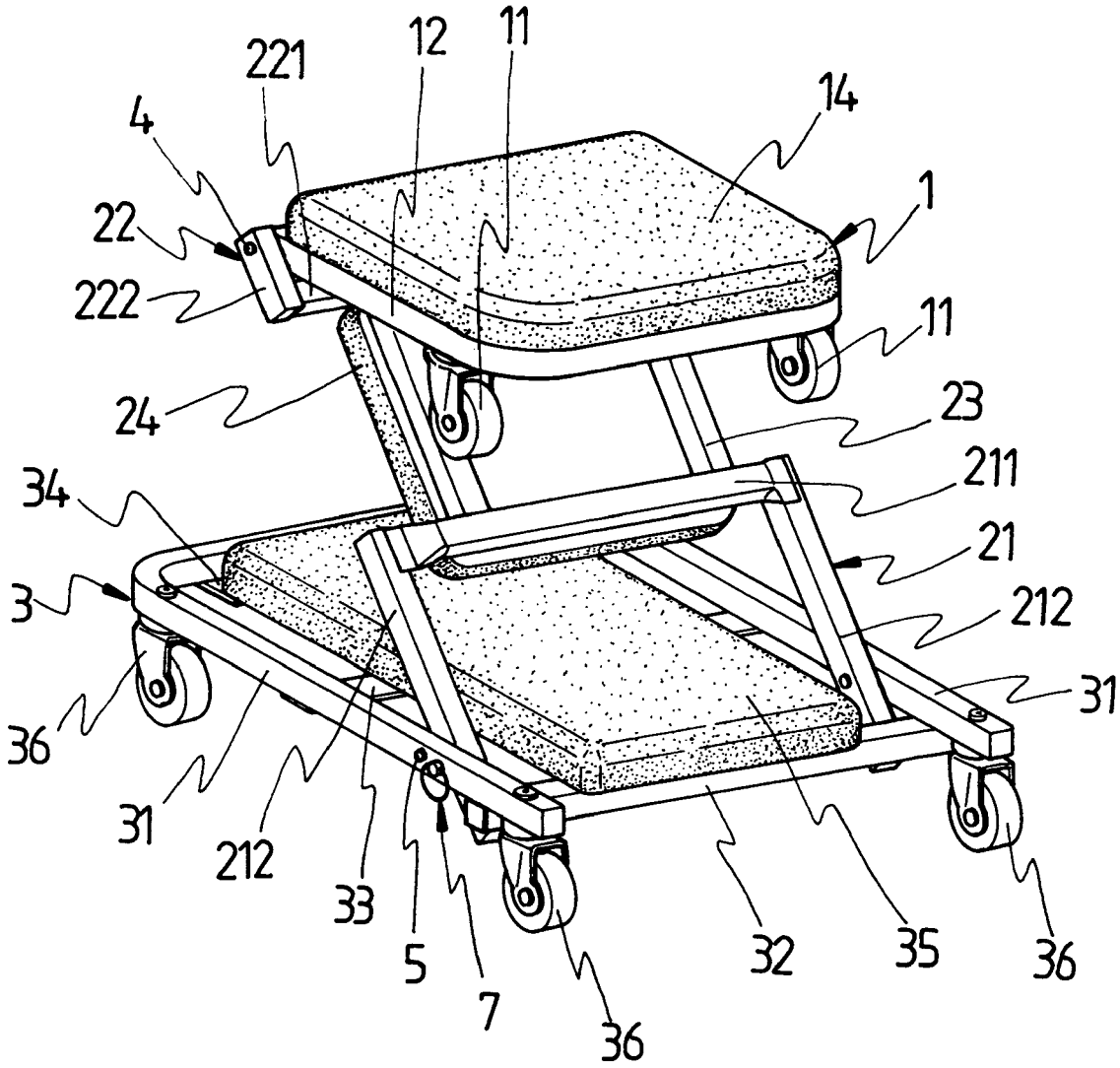
FIG. 5 is a perspective view of the present invention in a sitting configuration.

Referring to FIG. 1, FIG. 3 and FIG. 4, in order to achieve a rotary mechanism for the front chair frame 1, the lateral bars 12 of the front chair frame 1 are placed between the short U-shaped frame 22 of the middle chair frame 2, and a pivoting shaft 4 is inserted through pivot holes 13 and 223. To achieve a rotary mechanism for the middle chair frame 2, the rear chair frame 3 and the long U-shaped frame 21 of the middle chair frame 2 are coupled by inserting a pivoting shaft 5 through pivot holes 311 and 213. Referring to FIG. 5, to achieve a sitting configuration, the middle chair frame 2 is folded up, and then the lateral bars 212 of the long U-shaped frame 21 are supported against the supporting bar 32 of the rear chair frame 3 and the lateral bars 12 of the front chair frame 1 are supported against the central transverse bar 221 of the shorter U-shaped frame 22 of the middle chair frame 2.

Figure 6:
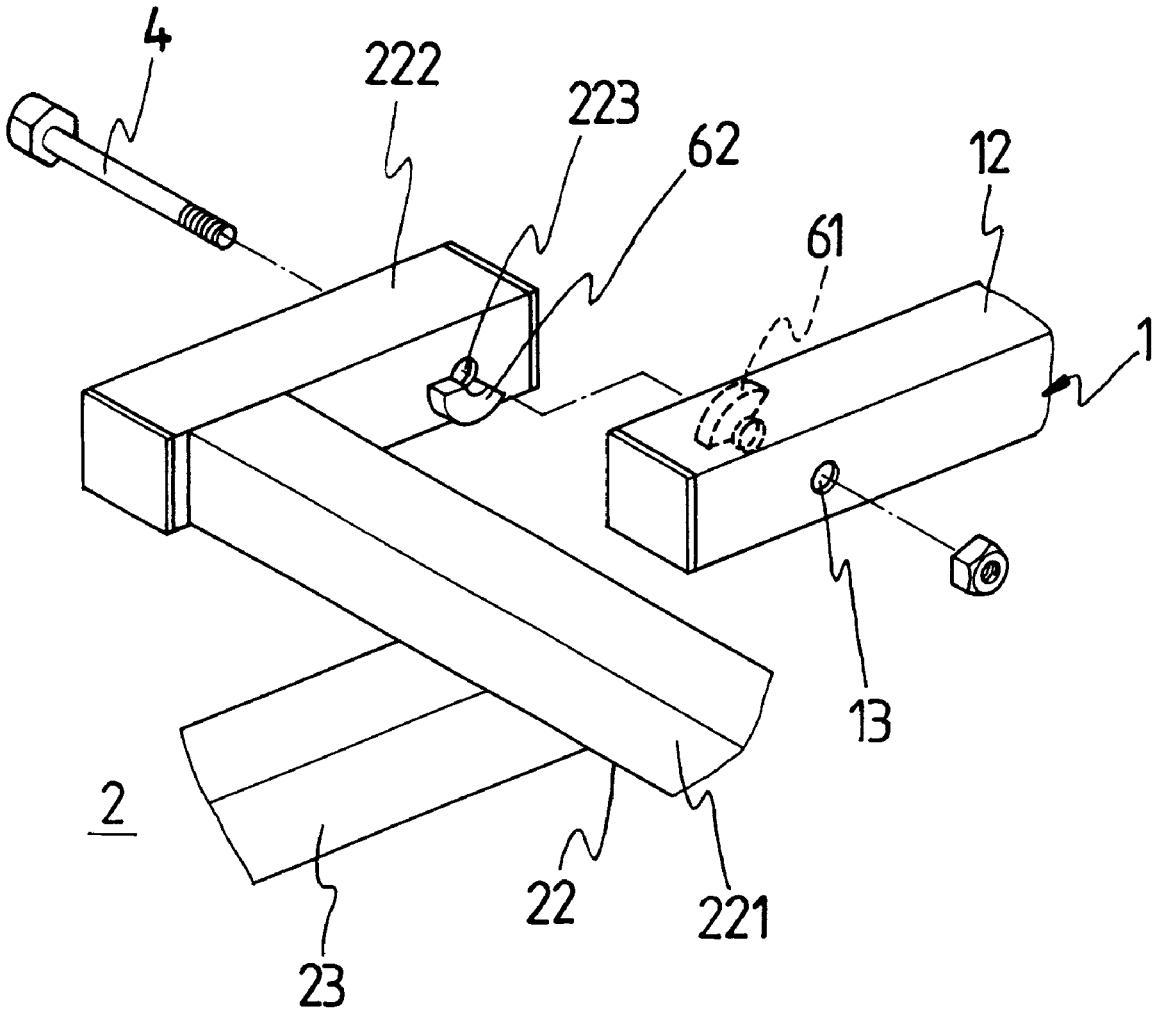
FIG. 6 is an exploded perspective view of the stopper of the present invention.
Figure 7:
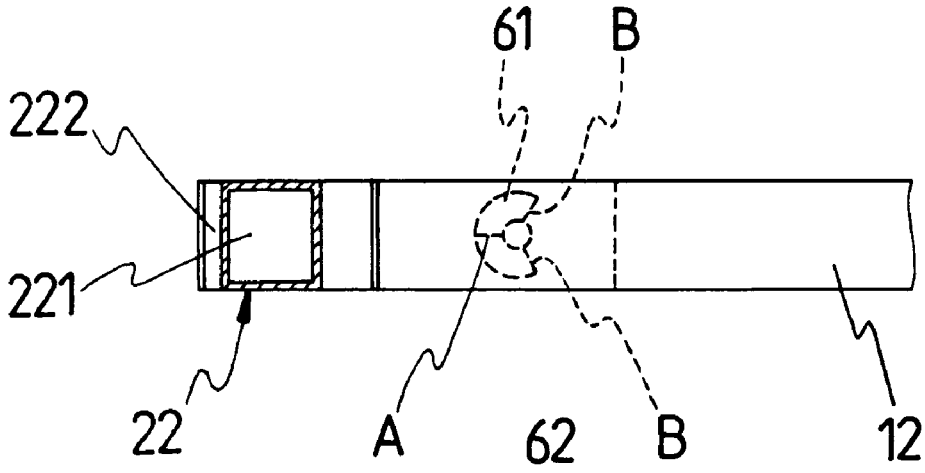
FIG. 7 is a cross-sectional view of the stopper of the present invention.
Figure 8:
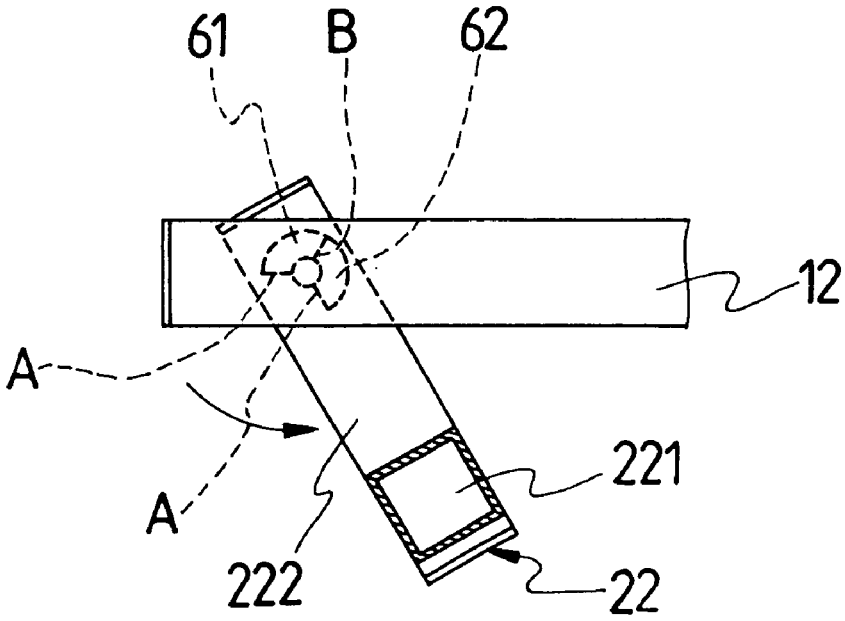
FIG. 8 is a cross-sectional view showing the action of the stopper of the present invention.

Referring to FIG. 6, to control the angle between the front chair frame 1 and the middle chair frame 2, a stopper 6 is installed at each of the pivoting places where the pivoting shaft 4, the pivot hole 223 and the pivot hole 13 are connected. The stopper 6 is composed of an upper ring stop 61 and a lower ring stop 62, the upper ring stop 61 is mounted in the upper rim portion around the pivot hole 13 on the outer side of a lateral bars 12 of the front chair frame 1, extending over a predetermined angle (about 113 degrees), and the lower ring stop 62 is mounted in the lower rim portion around the pivot hole 223 on the inner side of a lateral bars 212 of the short U-shaped frame 22, extending over a predetermined angle (about 113 degrees). Referring to FIG. 7, to maintain the flat configuration of the front chair frame 1 and the middle chair frame 2, the terminal faces A of the upper ring stop 61 and the lower ring stop 62 of a stopper 6 are held against each other in the combined structure of the pivoting shaft 4, pivot hole 223 and pivot hole 13. Referring FIG. 8, as the front chair frame 1 and the middle chair frame 2 are folded to form an upright configuration which is maintained by the lateral bars 12 of the front chair frame 1 being supported against the central transverse bar 221 of the shorter U-shaped frame 22 of the middle chair frame 2, and the upper ring stop 61 and the lower ring stop 62 are driven to rotate until the terminal faces B thereof are brought against each other and a proper sitting angle of the bench is stabilized by the stoppers 6.

Figure 9:
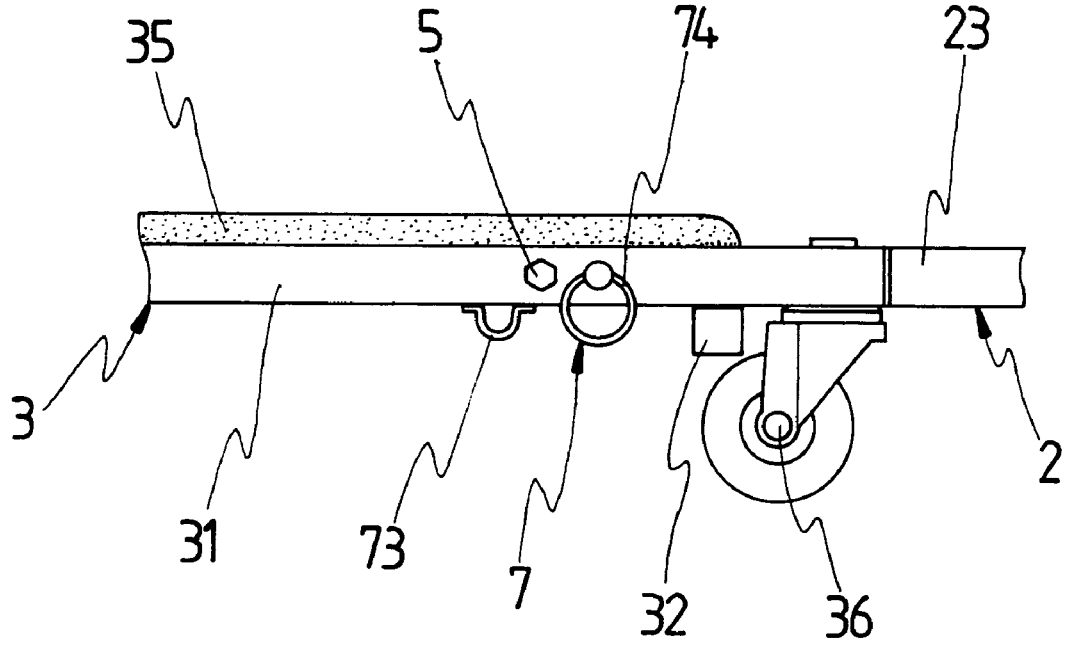
FIG. 9 is a partial left side elevational view of the locating device of the present invention.
Figure 10:
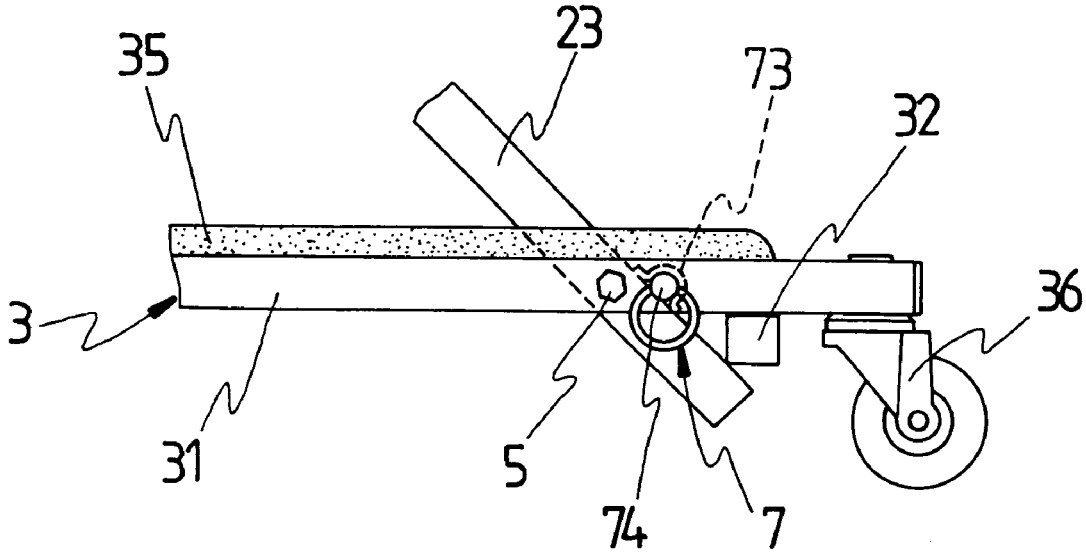
FIG. 10 is a partial left side elevational view showing the action of the locating device of the present invention.

Referring to FIG. 2, a locating device 7 is installed at one of the pivoting places where the pivoting shaft 5, the pivot hole 311 and the pivot hole 2.13 are connected. The locating device 7 is composed of a pin hole 71, a pin hole 72, a locking ring 73 and a locating pin 74. The pin hole 71 is located on a predetermined location near the pivot hole 311 on a lateral bar 31 of the rear chair frame 3, the pin hole 72 is located on a predetermined location near the pivot hole 213 on a corresponding lateral bar 212 of the long U-shaped frame 21 and the locking ring 73 is installed on a predetermined location on the bottom face of a lateral bar 212 around the pin hole 72. To maintain the flat configuration of the middle chair frame 2 and the rear chair frame 3, the locating pin 74 is inserted through both the pin hole 71 and the pin hole 72, as shown in FIG. 2 and FIG. 9. Referring to FIG. 10, as the middle chair frame 2 is folded and the lateral bars 212 of the long U-shaped frame 21 are supported against the supporting bar 32 of the rear chair frame 3, the locking ring 73 is actuated to rotate accordingly so that the locating pin 74 is relocated in the pin hole 71 and the locking ring 73. To ass st the supporting bar 32 supporting the folded middle chair frame 2, the locating device 7 provides a locking mechanism for stabilizing the sitting configuration of the bench, as shown in FIG. 5.

Figure 11:
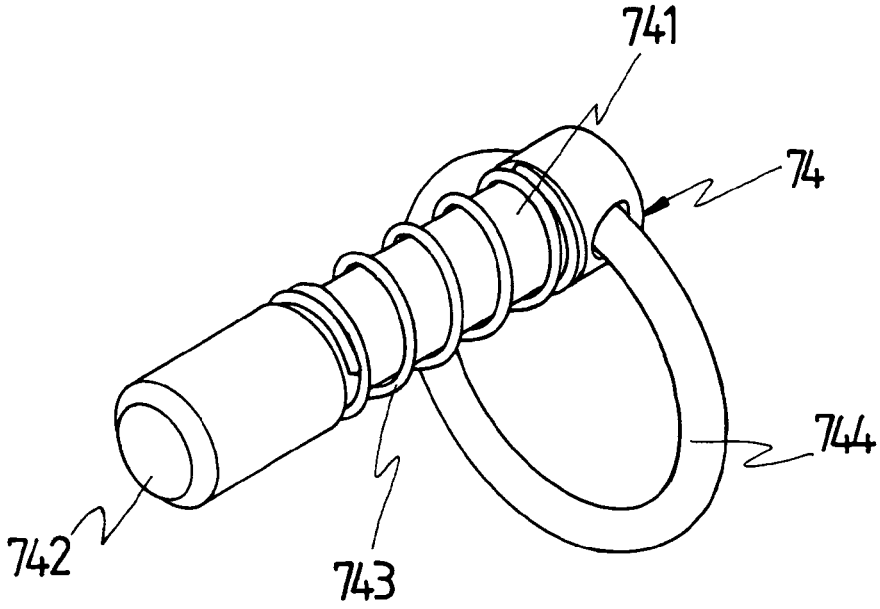
FIG. 11 is a perspective view of the locating pin of the present invention.
Figure 12:
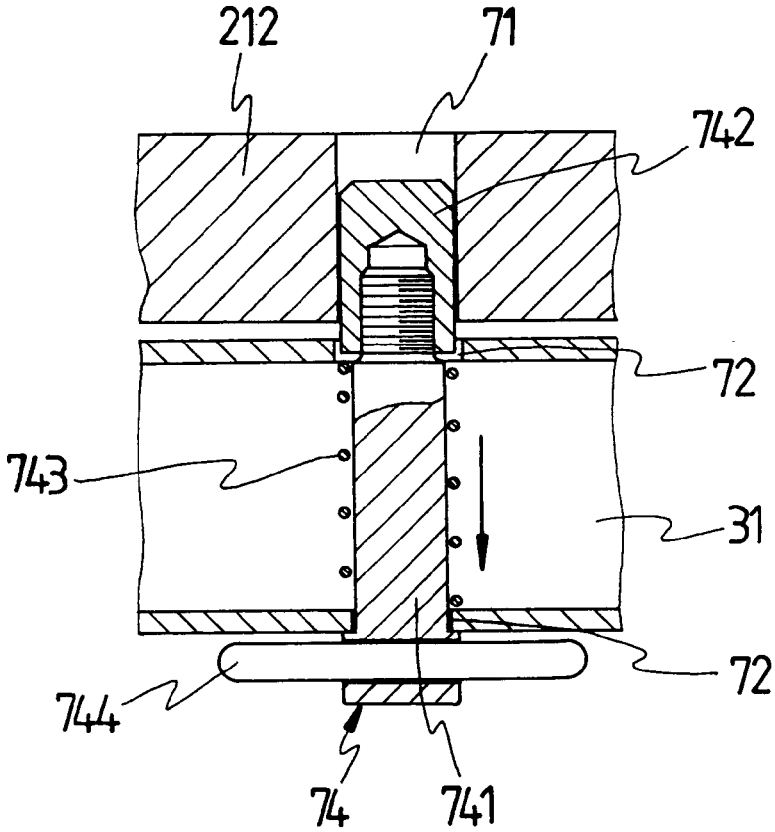
FIG. 12 is a cross-sectional view of the locating device of the present invention.

Referring to FIG. 11 and FIG. 12, the locating pin 74 of the locating device 7 includes a pin 741, a fixing cap 742, a resilient component 743 and a ring puller 744. The ring puller 744 goes through the rear end of the pin 741. The resilient component 743 is slipped on the pin 741 and confined by a fixing cap 742 that is screwed onto the front end of the pin 741. When the locating pin 74 is located in the pin hole 71 and the pin hole 72, the fixing cap 742 is retained in r:he pin hole 72, and the rear end of the resilient component 743 is held against the inner wall of the pin hole 71. By pulling the ring puller 744, the fixing cap 742 may be departed from the pin hole 72 and relocated into the locking ring 73.

The present invention can be used both as a common chair and a work chair for lying and sitting. It is particularly suitable for workplace where a variety of operational postures are in demand, such as lying, sitting and stepping. To form a lying configuration, the front chair frame 1, the middle chair frame 2 and the rear chair frame 3 are all leveled off, as shown in FIG. 1. To form a sitting configuration, the front chair frame 1, the middle chair frame 2 and the rear chair frame 3 are folded up, at the same time stabilized by the pivoting devices, the stopper 6 and the locating device 7, to form a Z-shaped configuration, as shown in FIG. 5.

What is claimed is:

1. A two-way caster bench comprising a front chair frame being a U-shaped frame including two lateral bars and having a plurality of casters installed on a bottom side thereof, a cushion being mounted on an upper side thereof;

a middle chair frame including two U-shaped frames having two pairs of lateral bars of different lengths connected by a pair of connecting bars, said two U-shaped frames having free ends of the lateral bars facing outwardly; and a rear chair frame being a U-shaped frame including two lateral bars, a supporting bar being mounted underneath and connecting front portions of the two lateral bars of said rear chair frame, a cushion being mounted on an upper side of said rear chair frame, a plurality of casters being installed on a bottom side of said rear chair frame;

said two lateral bars of said front chair frame being inserted between and pivotally connected with the shorter pair of lateral bars of said two U-shaped frames of said middle chair frame so that said front chair frame is foldable, said rear chair frame being pivotally connected with the longer pair of lateral bars of said two U-shaped frames of said middle chair frame so that said middle chair frame is foldable, said front chair frame being foldable toward the middle chair frame so that the lateral bars of the front chair frame supports against the shorter U-shaped frame of the middle chair frame and said middle chair frame being foldable toward said rear chair frame so that said supporting bar of said rear chair frame supports against said longer pair of lateral bars of said middle chair frame to maintain a sitting configuration.

2. The two-way caster bench of claim 1, wherein a first pivot hole extends through a free end of each of said lateral bars of said front chair frame; a second pivot hole extends through each of said shorter lateral bars of said U-shaped frame of said middle chair frame; a pivoting shaft is inserted through said first and second pivot holes to pivotally connect said front chair frame and said middle chair frame.

3. The two-way caster bench of claim 2, wherein a stopper is installed at each of said pivoting connections between said front chair frame and said middle chair frame; said stopper includes an upper ring stop mounted in an upper rim portion around said first pivot hole on an outer face of a lateral bar of said front chair frame; a lower ring stop mounted in a lower rim portion around said second pivot hole on an inner side of a shorter lateral bar of said U-shaped frame of said middle chair frame; said pivoting shaft is inserted through said first and second pivot holes to form a pivotal connection by which said upper ring stop and said lower ring stop may rotate during folding of the bench until a pair of terminal faces thereof engage each other.

4. The two-way caster bench of claim 2, wherein a third pivot holes extends through each of said lateral bars of said rear chair frame; a fourth pivot hole extends through said longer lateral bars of said U-shaped frame of said middle chair frame; a pivoting shaft is inserted through said third and fourth pivot holes to pivotally connect said rear chair frame and said middle chair frame.

5. The two-way caster bench of claim 4, wherein a locating device is installed adjacent at least one of said pivoting connections between said rear chair frame and said middle chair frame; said locating device includes a first pin hole, a second pin hole, a locking ring and a locating pin; said first pin hole is located adjacent said third pivot hole on a lateral bar of said rear chair frame; said second pin hole is located adjacent said fourth pivot hole on a corresponding longer lateral bar of said U-shaped frame of said middle chair frame; said locking ring is installed on a bottom face of a longer lateral bar of said U-shaped frame of said middle chair frame; said locating pin being insertable into said first pin hole and either of said second pin hole and said locking ring.

6. The two-way caster bench of claim 5, wherein said locating pin of said locating device comprises a pin, a fixing cap, a resilient component and a ring puller; said ring puller extending through a rear end of said pin; and said resilient component is slipped on said pin and confined by said fixing cap being screwed onto a front end of said pin.

7. The two-way caster bench of claim 1, wherein each of a middle section and a rear section of said rear chair frame under said lateral bars is provided with a supporting plate.

* * * * *